US007537874B2

(12) United States Patent
Mang et al.

(10) Patent No.: US 7,537,874 B2
(45) Date of Patent: May 26, 2009

(54) TONER WITH HIGH STRENGTH MAGNETITE

(75) Inventors: Mark E. Mang, Rochester, NY (US); Hui Chang, Pittsford, NY (US); Michael L. Grande, Palmyra, NY (US); Gary A. Minagawa, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 486 days.

(21) Appl. No.: 11/359,137

(22) Filed: Feb. 21, 2006

(65) Prior Publication Data

US 2007/0196755 A1 Aug. 23, 2007

(51) Int. Cl.
*G03G 9/083* (2006.01)

(52) U.S. Cl. ..... 430/106.2; 430/111.41

(58) Field of Classification Search ..... 430/106.2, 430/111.41

See application file for complete search history.

(56) References Cited

U.S. PATENT DOCUMENTS

| | | | | |
|---|---|---|---|---|
| 3,627,682 | A | 12/1971 | Hall et al. | |
| 4,105,572 | A | 8/1978 | Gorondy | |
| 4,695,524 | A | 9/1987 | Knapp et al. | |
| 5,843,631 | A | 12/1998 | Mihayashi et al. | |
| 5,914,209 | A | 6/1999 | Grushkin | |
| 6,656,658 | B2 * | 12/2003 | Patel et al. | 430/137.14 |
| 7,214,458 | B2 * | 5/2007 | Mang et al. | 430/108.1 |
| 2003/0073016 | A1 * | 4/2003 | Hayashi et al. | 430/106.2 |
| 2004/0265728 | A1 | 12/2004 | Patel et al. | |
| 2006/0003244 | A1 | 1/2006 | Grande et al. | |

FOREIGN PATENT DOCUMENTS

| | | |
|---|---|---|
| JP | 60057859 | 4/1985 |

* cited by examiner

*Primary Examiner*—John L Goodrow
(74) *Attorney, Agent, or Firm*—Carter, DeLuca, Farrell & Schmidt, LLP

(57) ABSTRACT

A toner having a high strength magnetite in an amount of from about 10 to about 40 weight percent, wherein the magnetite includes a material selected from the group consisting of FeO, $Fe_2O_3$, $Fe_3O_4$, gamma iron oxides, cobalt-gamma iron oxides, and mixtures thereof, and further including a developer having a carrier and toner as just described.

21 Claims, 1 Drawing Sheet

CSF-4090V2P X 30,000 BET: 39.5 m2/g

CSF-4090V2P X 30,000 BET: 39.5 m2/g

CSB-191NV2 X 30,000 BET: 36.5 m2/g

TONER WITH HIGH STRENGTH MAGNETITE

BACKGROUND

The present disclosure relates to toner, and in embodiments, MICR toner, useful in electrostatographic, electrophotographic, xerographic, and the like machines, including printers, copiers, scanners, facsimiles, and the like, including digital and image-on-image machines. The toner herein, includes a high strength magnetite.

Magnox magnetite is used in known toners, such as MICR toners. Although this and other known magnetites may work well in some cases, a problem results due to the fact that large amounts of magnetite are needed for signal strength. More specifically, amounts of 22 weight percents or more are needed to get adequate signal strength. Having a high solids content presents many challenges for fusing of the magnetic toner. In addition, such high magnetite loads do not work well with certain toner resins. Producing new resins to work with high magnetite loadings results in high research and development cost, and increases time to launch. In addition, having such high magnetite loadings increases the toner processes, leading to more time and expense to produce magnetic toners.

U.S. Pat. No. 5,296,326 to Canon discloses a magnetite comprising various amounts of iron oxides.

The aforementioned patent is totally incorporated by reference herein in its entirety.

It is desired to provide a magnetic toner, and in embodiments, a MICR magnetic toner, which uses a less amount of magnetite, in order to decrease research and development, and processing costs, and in order to decrease time to launch. In addition, it is desired to provide a magnetic toner, and in embodiments, a MICR magnetic toner, which uses a less amount of magnetite, in order to reduce problems in fusing magnetic toner.

SUMMARY

Embodiments include a toner comprising a high strength magnetite in an amount of from about 10 to about 40 weight percent, wherein the magnetite comprises a material selected from the group consisting of FeO, $Fe_2O_3$, $Fe_3O_4$, gamma iron oxides, cobalt-gamma iron oxides, and mixtures thereof.

Embodiments further include a toner comprising a high strength magnetite in an amount of from about 10 to about 40 weight percent, wherein the magnetite comprises a material selected from the group consisting of FeO, $Fe_2O_3$, $Fe_3O_4$, gamma iron oxides, cobalt-gamma iron oxides, and mixtures thereof, wherein the magnetite has a high coercivity of from about 400 to about 1,000.

Embodiments also include a developer composition comprising a toner comprising a high strength magnetite in an amount of from about 10 to about 40 weight percent, wherein the magnetite comprises a material selected from the group consisting of FeO, $Fe_2O_3$, $Fe_3O_4$, gamma iron oxides, cobalt-gamma iron oxides, and mixtures thereof, and further comprising carrier particles.

DETAILED DESCRIPTION

Figure 1:
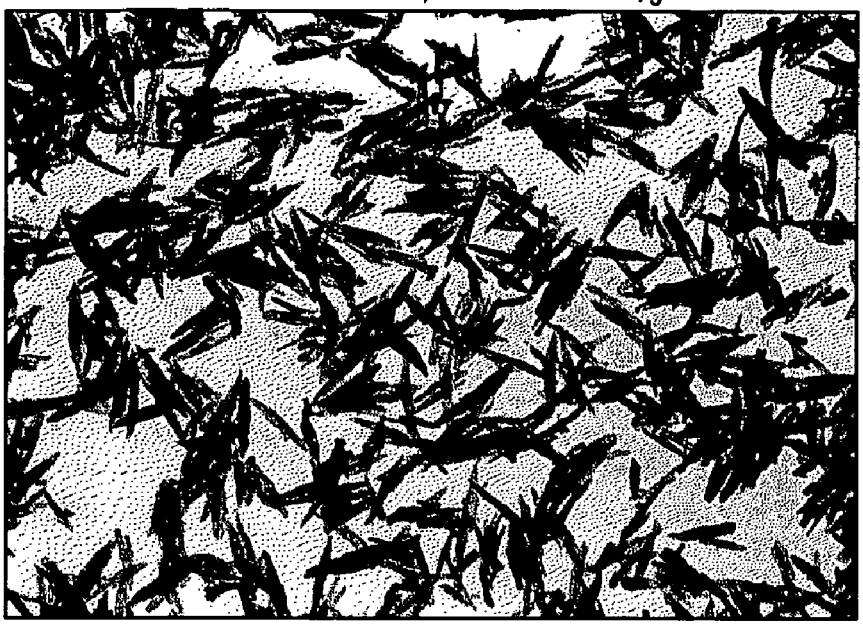
FIG. 1 is a photograph of an embodiment of a magnetite, and demonstrates the needle shape of a sample of cobalt-gamma iron oxide magnetite.
Figure 2:
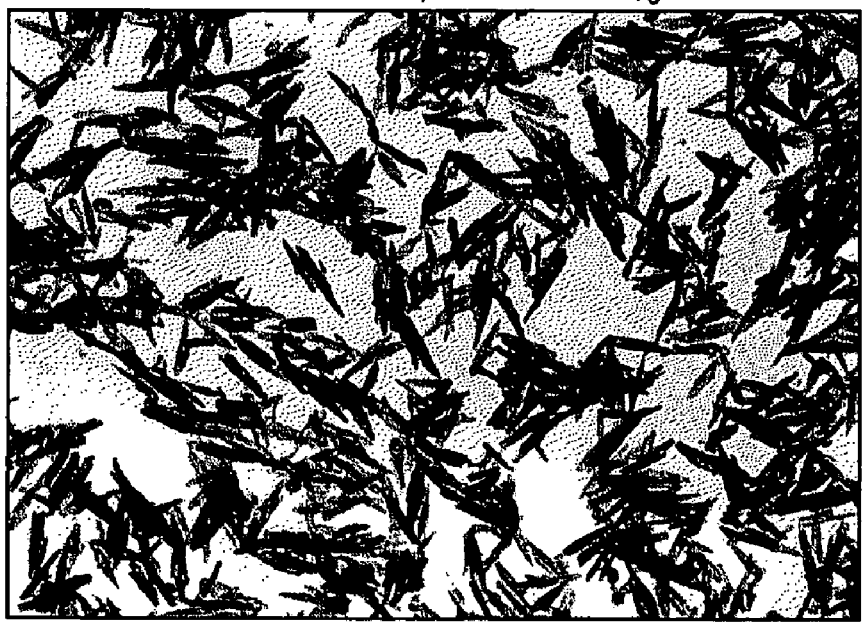
FIG. 2 is a photograph of an embodiment of a magnetite, and demonstrates the needle shape of a sample of gamma iron oxide magnetite.

Herein is disclosed use of high magnetic strength magnetite in toner, especially for MICR toner. In embodiments, a relatively small amount of the magnetite is needed in order to obtain good signal strength, reduce problems with fusing of the magnetic toner, decrease costs of making new resins and making toners with large amounts of magnetites, and decrease time to launch.

In normal operations, an amount of about 22 percent or more magnetite is used in toner and developer compositions. In embodiments, the high strength magnetite herein is present in the toner in an amount of from about 10 to about 20 percent, or from about 12 to about 14 percent, or from about 12 to about 16 percent by weight of total solids in the toner.

The toner herein comprises a magnetite such as high strength magnetites. Examples include iron oxides, such as Iron II oxide, Iron III oxide, FeO, $FeO_3$, $Fe_2O_3$, $Fe_3O_4$, gamma iron oxides (such as CSB-191NV2 from TODA), cobalt-gamma iron oxides (such as CSF-4090V2P from TODA), and the like. Commercially available magnetites can be those high strength magnetites from TODA Magnetite Corporation. Other useful magnetites include those TODA magnetites as referenced in U.S. Pat. Nos. 5,843,631; 6,296,996; and 6,303,280 as examples. The disclosure of these patents is hereby incorporated by reference in their entireties. Other TODA magentites include CSF-4090V2P, CSB-191NV2, and the like; and mixtures thereof. Specific examples include magnetites comprising gamma iron oxide having $Fe_3O_4$ as a core material, and comprising cobalt-gamma iron oxide having $Fe_2O_3$ as a core material.

In embodiments, the magnetite is needle shaped, but can be other shapes such as spherical, cone-shaped, irregular, octahedral, and cubic.

In embodiments, the magnetites have a high coercivity of from about 400 to about 1,000, or from about 500 to about 1,000, or from about 800 to about 1,000, or from about 850 to about 950 Oe. Previously used magnetites for MICR applications have a small coercivity of only about 375 Oe.

In embodiments, the magnetite has a moisture less than about 0.8, or from about 0.01 to about 0.8, or from about 0.1 to about 0.8.

In embodiments, the Hc of the magnetite is from about 850 to about 950, or from about 890 to about 930.

In embodiments, the r/s of the magnetite is from about 0.4 to about 0.8, or from about 0.45 to about 0.8.

In embodiments, the moment of the magnetite is from about 70 to about 85, or from about 76 to about 82.

In embodiments, the magnetite has a BET of from about 30 to about 45, or from about 35 to about 40, or from about 36.5 to about 39.5.

In embodiments, the $Fe_2$ content of the magnetite is from about 1 to about 20, or from about 4 to about 15.

In embodiments, the density of the magnetite is from about 0.5 to about 0.8, or from about 0.69 to about 0.7.

In embodiments, the $SiO_2$ content in the toner is from about 1 to about 1.5, or from about 1.2 to about 1.4, or about 1.32.

In embodiments, the pH of the magnetite is from about 8 to about 10, or from about 9 to about 9.5

In embodiments, the toner can comprise a colorant. The colorant can be, for example, known dyes or pigments, and the like materials, and mixtures thereof. The colorant can be a pigment, for example, a carbon black, a magnetite, a cyan pigment, a magenta pigment, a yellow pigment, a red pigment, a green pigment, a blue pigment, a brown pigment, or mixtures thereof. Examples of suitable carbon blacks include REGAL® 330 carbon blacks (Cabot), Carbon Black 5250 and 5750 (Columbian Chemicals), BLACK PEARLS®, VULCAN®, MAPICO BLACK®, and the like or mixtures thereof. Alternatively, there can be selected as pigment particles mixtures of carbon black or equivalent pigments and magnetites, which mixtures, for example, contain from about 10 to about 20 percent, or from about 12 to about 16 percent, or from about 12 to about 14 percent by weight of magnetite, and from about 0.5 percent to about 15 percent, or from about 2 to about 10 percent, or from about 3 to about 5 percent by weight of a colorant, for example, carbon black.

The toner can further comprise charge additives, for example, present in amounts of from about 0.05 to about 5 weight percent, or from about 0.1 to about 3 weight percent. A positive or a negative charge additive, or mixtures thereof, may be selected providing that the resulting toner, in embodiments, has a net positive charging characteristic. Thus, various known external additives in various amounts may be included in formulating toner and their relative amounts balanced so as to achieve a toner composition, which has a net positive charging character.

Toner compositions herein, in embodiments, can further comprise a wax additive with a weight average molecular weight of from about 1,000 to about 20,000, wherein the wax can be integral, that is, in intimate admixture, with the bulk toner. The wax can be present in an amount of from about 1 to about 10 percent, or from about 2 to about 8 percent or from about 5 to about 8 percent by weight of total solids in the toner composition. The wax can be a surface additive or not, and the wax can be, for example, polyethylene (such as VISCOL 550P™ and VISCOL 660P™ from Sanyo Chemicals of Japan; and POLYWAX® 500 and POLYWAX® 655 from Baker-Petrolite), polypropylene, aliphatic alcohols, paraffin, ester waxes, natural waxes such as Carnauba wax, and mixtures thereof, and the like compounds.

Toners herein can include resins. The resin particles can be, in embodiments, styrene acrylates, styrene butadienes, styrene methacrylates, polyesters, including crystalline polyesters, partially crystalline polyesters, and the like. A "partially crosslinked" polyester is a polymer mixture of linear molecules and covalently bonded (crosslinked) molecules. The ratio of these can be changed depending on how far the reaction is allowed to proceed. U.S. Pat. No. 6,359,105, the disclosure of which is hereby incorporated by reference in its entirety, discloses the process for making a partially crosslinked polyester. The resin can be present in various effective amounts, such as from about 60 weight percent to about 98 weight percent, or from about 70 to about 90 weight percent, or from about 72 to about 80 weight percent based upon the total weight percent of the toner.

Illustrative examples of latex polymer or resin particles include known polymers selected from the group consisting of styrene acrylates, styrene methacrylates, butadienes, isoprene, acrylonitrile, acrylic acid, methacrylic acid, beta-carboxy ethyl acrylate, polyesters (such as partially crosslinked propoxylated bisphenol A fumarate), poly(styrene-butadiene), poly(propoxylated bisphenol A fumarate), crystalline polyesters, partially crystalline polyesters, and the like.

In embodiments, linear unsaturated polyesters are used as the base resin. These linear unsaturated polyesters are low molecular weight condensation polymers, which may be formed by the step-wise reactions between both saturated and unsaturated diacids (or anhydrides) and dihydric alcohols (glycols or diols). The resulting unsaturated polyesters are reactive (e.g., cross-linkable) on two fronts: (i) unsaturation sites (double bonds) along the polyester chain, and (ii) functional groups such as carboxyl, hydroxyl, etc. groups amenable to acid-base reactions. Typical unsaturated polyester base resins useful herein are prepared by melt polycondensation or other polymerization processes using diacids and/or anhydrides and diols. Suitable diacids and dianhydrides include but are not limited to saturated diacids and/or anhydrides such as for example succinic acid, glutaric acid, adipic acid, pimelic acid, suberic acid, azelaic acid, sebacic acid, isophthalic acid, terephthalic acid, hexachloroendo methylene tetrahydrophthalic acid, phthalic anhydride, chlorendic anhydride, tetrahydrophthalic anhydride, hexahydrophthalic anhydride, endomethylene tetrahydrophthalic anhydride, tetrachlorophthalic anhydride, tetrabromophthalic anhydride, and the like and mixtures thereof; and unsaturated diacids and/or anhydrides such as for example maleic acid, fumaric acid, chloromaleic acid, methacrylic acid, acrylic acid, itaconic acid, citraconic acid, mesaconic acid, maleic anhydride, and the like and mixtures thereof. Suitable diols include but are not limited to for example propylene glycol, ethylene glycol, diethylene glycol, neopentyl glycol, dipropylene glycol, dibromoneopentyl glycol, propoxylated bisphenol A, ethoxylated bisphenol A and other alkoxylated bisphenol A diols, 2,2,4-trimethylpentane-1,3-diol, tetrabromo bisphenol dipropoxy ether, 1,4-butanediol, and the like and mixtures thereof, soluble in good solvents such as, for example, tetrahydrofuran, toluene and the like.

Unsaturated polyester base resins are prepared from diacids and/or anhydrides such as, for example, maleic anhydride, fumaric acid, and the like and mixtures thereof, and diols such as, for example, propoxylated bisphenol A, propylene glycol, and the like and mixtures thereof A particularly preferred polyester is poly(propoxylated bisphenol A fumarate).

In embodiments, the polyester resin is partially crosslinked propoxylated bisphenol A fumarate. The resin is propoxylated in any conventional manner.

In embodiments, an embrittling agent can be used with the toner composition. The embrittling agent or compatibilizer can be present in an amount of from about 1 to about 20 weight percent, or from about 3 to about 10 weight percent, or from about 5 to about 8 percent by weight of total solids in the toner. The embrittling agents or compatibilizers can comprise isopropenyl toluene, indene, like compatibilizers, polymers thereof, and copolymers thereof. Examples of embrittling agents or compatibilizers include those containing FMR-0150, FTR 6125, FTR-6125F, and the like from Mitsui Chemical, petroleum hydrocarbon resins such as LX-2600 resin, and the like from Neville Chemical Company, and the like. Specifics are as follows:

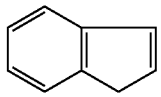

Indene

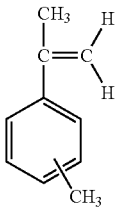

Isopropenyl toluene

There can also be blended with the toner compositions external additive particles including flow aid additives, which additives are usually present on the surface thereof. Examples of these additives include colloidal silicas, such as AEROSIL®, metal salts and metal salts of fatty acids inclusive of zinc stearate, aluminum oxides, cerium oxides, and mixtures thereof, which additives are generally present in an amount of from about 0.1 percent by weight to about 10 percent by weight, or in an amount of from about 0.1 percent by weight to about 5 percent by weight. Several of the aforementioned additives are illustrated in U.S. Pat. Nos. 3,590,000 and 3,800,588, the disclosures of which are totally incorporated herein by reference.

Surface additives that can be added to the toner compositions after washing or drying include, for example, metal salts, metal salts of fatty acids, colloidal silicas, metal oxides, mixtures thereof, and the like, which additives are usually present in an amount of from about 0.1 to about 10 weight percent. Reference can be made to U.S. Pat. Nos. 3,590,000, 3,720,617, 3,655,374 and 3,983,045, the disclosures of which are totally incorporated herein by reference. Examples of suitable additives include zinc stearate and AEROSIL R972® available from Degussa in amounts of from about 0.1 to about 10 percent. The additives can be added during the aggregation process or blended into the formed toner product.

The toner may also include known charge additives in effective amounts such as, from about 0.1 to about 5 weight percent, such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, and the like.

The toner particles can be of any size, and in embodiments, have a volume average diameter particle size, for example, of from about 4 to about 40 microns, or from about 4 to about 20 microns, or from about 4 to about 16 microns, or from about 4 to about 14 microns.

For the formulation of developer compositions, there are mixed with the toner particles carrier components, particularly those that are capable of triboelectrically assuming an opposite polarity to that of the toner composition. Accordingly, the carrier particles are selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference particles used the aforementioned coating composition, the coating generally containing terpolymers of styrene, methylmethacrylate, and a silane, such as triethoxy silane, reference U.S. Pat. Nos. 3,526,533, 4,937,166, and 4,935,326, the disclosures of which are totally incorporated herein by reference, including for example KYNAR® and polymethylmethacrylate mixtures (40/60). Coating weights can vary as indicated herein. However, from about 0.3 to about 2, or from about 0.5 to about 1.5 weight percent coating weight can be used.

Furthermore, the diameter of the carrier particles, such as spherical in shape, is generally from about 50 microns to about 1,000 microns, and in embodiments, about 77 to about 150 microns thereby permitting them to possess sufficient density and inertia to avoid adherence to the electrostatic images during the development process. The carrier component can be mixed with the toner composition in various suitable combinations. However, in embodiments, from about 1 to about 5 parts per toner to about 100 parts to about 200 parts by weight of carrier can be used.

Also provided herein are developer and imaging processes, including a process for preparing a developer comprising preparing a toner composition with the toner processes illustrated herein and mixing the resulting toner composition with a carrier. Developer compositions can be prepared by mixing the toners obtained with the processes of the present disclosure with known carrier particles, including coated carriers, such as steel, ferrites, and the like, reference U.S. Pat. Nos. 4,937,166 and 4,935,326, the disclosures of which are totally incorporated herein by reference, using, for example from about 2 to about 8 percent toner concentration. The carriers selected may also contain dispersed in the polymer coating a conductive compound, such as a conductive carbon black and which conductive compound is present in various suitable amounts, such as from about 15 to about 65, or from about 20 to about 45 weight percent by weight of total solids.

Imaging methods are also envisioned as part of the present disclosure, reference for example a number of the patents mentioned herein, and U. S. Pat. No. 4,265,660, the disclosure of which is totally incorporated by reference herein. Imaging processes comprise, for example, preparing an image with a xerographic device comprising a charging component, an imaging component, a photoconductive component, a developing component, a transfer component, and a fusing component; and wherein the development component comprises a developer prepared by mixing a carrier with a toner composition prepared with the toner processes illustrated herein; an imaging process comprising preparing an image with a xerographic device comprising a charging component, an imaging component, a photoconductive component, a developing component, a transfer component, and a fusing component; wherein the development component comprises a developer prepared by mixing a carrier with a toner composition prepared with the toner processes illustrated herein; and wherein the xerographic device comprises a high speed printer, a black and white high speed printer, a color printer, or combinations thereof.

The following Examples are being submitted to further define various species of the present disclosure. These Examples are intended to be illustrative only and are not intended to limit the scope of the present disclosure. Also, parts and percentages are by weight unless otherwise indicated.

EXAMPLES

Example 1

Preparation of Toner Formulation Using Polywax 660P

A series of toners whose formulation appears in Table 1 were made.

TABLE 1

Toners made with high strength magnetite

| Toner | Resin 1 (wt %) | Resin 2 (wt %) | 660P Wax (wt %) | Carbon Black (wt %) | Magnetite (wt %) | Magnetite type |
|---|---|---|---|---|---|---|
| 1 | 70 | 8 | 5 | 5 | 12 | CSB-191NV2 |
| 2 | 76 | 8 | 5 | 5 | 6 | CSB-191NV2 |
| 3 | 70 | 8 | 5 | 5 | 12 | CSF-4090V2P |
| 4 | 76 | 8 | 5 | 5 | 6 | CSF-4090V2P |

In the above formulations, resin 1 is a partially crosslinked propoxylated bisphenol-A fumarate, and resin 2 is FTR-6125F.

These toners were melt mixed using a Werner and Pfleiderer ZSK-25MC extrude. The raw materials were melt mixed in the extruder with a barrel temperature of 150° C., a screw speed of 225 RPM, and a throughput rate of 70 lb/hr. The resulting toner was ground in an Alpine AFG 200 fluidized bed grinder. After grinding, the toners were classified using an Acucut Model B18 classifier to a volume median of about 9 microns by removal of the fine particles. Fine particles are those below 4 microns. Silicon oxides and titanium oxides were dry blended onto the toner surface to facilitate charging and flowability. Toner #1 from the matrix above was run in a Xerox DP 75MX machine. Two sets of checks were produced and run through a BTI reader/sorter. None of the checks were rejected. The operator also noted that image quality improved using this toner formulation compared to the stock DP 75MX toner. Specifically the operator noted the halftone graininess, reload, and halo were all reduced. The other toners have not been machine tested.

The magnetic properties of the resulting toners can be found in Table 2.

TABLE 2

Magnetic properties of toners

| Toner | Coercivity (Oe) | Retentivity (emu/g) | Magnetization (emu/g) |
|---|---|---|---|
| 1 | 906.9 | 4.39 | 8.8 |
| 2 | 905.8 | 2.24 | 4.6 |
| 3 | 847.4 | 4.11 | 8.3 |
| 4 | 840.5 | 2.13 | 4.4 |
| DP 75MX | 420.9 | 7.49 | 16.4 |

Example 2

Preparation of Toner Formulations Using Carnauba Wax and Polywax 2000

A series of toners whose formulation appears in Table 3 were made.

TABLE 3

Toners made with high strength magnetite

| Toner | Resin 1 (wt %) | Resin 2 (wt %) | PW2000 Wax (wt %) | Carnauba Wax (wt %) | Carbon Black (wt %) | Magnetite (wt %) | Magnetite type |
|---|---|---|---|---|---|---|---|
| 1 | 78 | 0 | 5 | 2 | 3 | 12 | CSB-191NV2 |
| 2 | 74 | 0 | 5 | 2 | 3 | 16 | CSB-191NV2 |
| 3 | 75 | 0 | 5 | 5 | 3 | 12 | CSB-191NV2 |
| 4 | 71 | 0 | 5 | 5 | 3 | 16 | CSB-191NV2 |
| 5 | 74.5 | 0 | 5 | 3.5 | 3 | 14 | CSB-191NV2 |
| 6 | 74.5 | 0 | 5 | 3.5 | 3 | 14 | CSF-4090V2P |
| 7 | 54.5 | 20 | 5 | 3.5 | 3 | 14 | CSB-191NV2 |

In the above toner formulations, resin 1 is a partially crosslinked propoxylated bisphenol-A fumarate, and resin 2 is Kao CPES A3C partially crystalline polyster.

These toners were melt mixed using a Werner and Pfleiderer ZSK-40SC extruder. The raw materials were melt mixed in the extruder with a barrel temperature of 90° C., a screw speed of 170 RPM, and a throughput rate of 90 lb/hr. The resulting toners were ground in an Alpine AFG 200 fluidized bed grinder. After grinding it was classified using an Acucut Model B18 classifier to a volume median of about 9 microns by removal of the fine particles. Fine particles are those below 4 microns. Silicon oxides and titanium oxides were dry blended onto the toner surface to facilitate charging and flowability.

These materials have not been tested yet.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A toner comprising a high strength magnetite in an amount of from about 10 to about 20 weight percent, wherein said magnetite comprises a material selected from the group consisting of FeO, $Fe_2O_3$, $Fe_3O_4$, gamma iron oxides, cobalt-gamma iron oxides, and mixtures thereof, and wherein said high strength magnetite has a coercivity of from about 500 to about 1,000.

2. A toner in accordance with claim 1, wherein said magnetite comprises gamma iron oxide having $Fe_3O_4$ as a core material.

3. A toner in accordance with claim 1, wherein said magnetite comprises cobalt-gamma iron oxide having $Fe_2O_3$ as a core material.

4. A toner in accordance with claim 1, wherein said amount is from about 12 to about 16 percent by weight of total solids.

5. A toner in accordance with claim 4, wherein said amount is from about 12 to about 14 percent by weight of total solids.

6. A toner in accordance with claim 1, wherein said magnetite das a high coercivity of from about 800 to about 1,000 Oe.

7. A toner in accordance with claim 1, wherein the toner comprises toner particles with a volume average diameter particle size of from about 4 to about 40 microns.

8. A toner in accordance with claim 7, wherein said volume average diameter particle size is from 4 to about 20 microns.

9. A toner in accordance with claim 1, wherein said magnetite is needle shaped.

10. A toner in accordance with claim 1, wherein said said magnetite has a Bet of from about 30 to about 45.

11. A toner in accordance with claim 1, wherein said toner further comprises a colorant present in an amount of from about 0.5 to about 15 percent based on the total weight of the toner.

12. A toner in accordance with claim 1, wherein said toner further comprises a resin.

13. A toner in accordance with claim 12, wherein said resin is a polyester.

14. A toner in accordance with claim 13, wherein said polyester resin is partially crosslinked.

15. A toner in accordance with claim 14, wherein said partially crosslinked polyester is a propoxylated bisphenol-A fumarate.

16. A toner in accordance with claim 1, wherein said further comprises an embrittling agent in an amount of from 1 to about 20 percent by weight of total solids in the toner.

17. A toner in accordance with claim 16, wherein said embrittling agent is selected from the group consisting of isopropenyl toluene, indene, polymers thereof, and copolymers thereof.

18. A toner comprising a high strength magnetite in an amount of from about 12 to about 16 weight percent, wherein said magnetite comprises a material selected from the group consisting of FeO, $Fe_2O_3$, $Fe_3O_4$, gamma iron oxides, cobalt-gamma iron oxides, and mixtures thereof, wherein said magnetite has a high coercivity of from about 800 to about 1,000 Oe.

19. A developer composition comprising a toner comprising a high strength magnetite in an amount of from about 10 to about 20 weight percent, wherein said magnetite comprises a material selected from the group consisting of FeO, $Fe_2O_3$, $Fe_3O_4$, gamma iron oxides, cobalt-gamma iron oxides, and mixtures thereof, wherein said magnetite is needle-shaped and has a pH of from about 8 to about 10.

20. A toner in accordance with claim 1, further comprising an embrittling agent.

21. A toner in accordance with claim 20, wherein said embrittling agent is a petroleum hydrocarbon resin having the following Formula I:

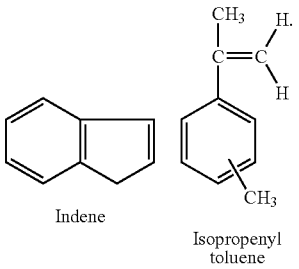

* * * * *